US005328242A

United States Patent [19]

Steffens et al.

[11] Patent Number: 5,328,242

[45] Date of Patent: Jul. 12, 1994

[54] CHAIR WITH BACK LOCK

[75] Inventors: James P. Steffens, Hopkins; Russell T. Holdredge, Alto, both of Mich.

[73] Assignee: Steelcase Inc., Grand Rapids, Mich.

[21] Appl. No.: 852,306

[22] Filed: Mar. 18, 1992

[51] Int. Cl.[5] ..... B60N 2/02

[52] U.S. Cl. ..... 297/374; 297/313; 74/527; 74/531; 74/500.5; 74/501.5 R; 74/501.6; 74/502; 74/502.4; 74/502.6

[58] Field of Search ..... 297/328, 374, 375, 355, 297/340, 354.12, 306, 300, 313, 337; 74/527, 531, 500.5, 501.5 R, 501.6, 502, 502.4, 502.6

[56] References Cited

U.S. PATENT DOCUMENTS

| | | | |
|---|---|---|---|
| T103,201 | 7/1983 | Robinson | 297/367 |
| 1,302,212 | 4/1919 | Phillips . | |
| 1,348,121 | 7/1920 | Kuderer | 297/306 X |
| 1,699,894 | 1/1929 | Klemm | 297/366 |
| 2,278,080 | 3/1942 | Koenigkramer et al. | 297/328 |
| 2,310,476 | 2/1943 | Todd . | |
| 2,827,951 | 3/1958 | Herider et al. . | |
| 2,894,566 | 7/1959 | Herider et al. | 297/363 |
| 2,912,045 | 11/1959 | Milly | 297/363 |
| 3,046,055 | 7/1962 | Martens | 297/361 |
| 3,062,584 | 11/1962 | Galla | 297/374 |
| 3,111,343 | 11/1963 | Pearson | 297/306 |
| 3,127,788 | 4/1964 | Martens | 74/586 |
| 3,295,885 | 1/1967 | Barksdale | 297/306 X |
| 3,339,975 | 9/1967 | Posh | 297/361 |
| 3,350,135 | 10/1967 | Martens | 297/355 |
| 3,356,411 | 12/1967 | Homier et al. | 297/355 |
| 3,369,841 | 2/1968 | Heyl, Jr. | 297/361 |
| 3,515,433 | 6/1970 | Tabor | 297/374 |
| 3,517,965 | 6/1970 | Cowles et al. | 297/374 |
| 3,727,974 | 4/1973 | Swenson et al. | 297/300 |
| 3,801,155 | 4/1974 | Hodgen et al. | 297/374 |
| 3,897,608 | 8/1975 | Impicciche | 297/364 X |
| 3,916,461 | 11/1975 | Kerstholt | 5/66 |
| 3,975,050 | 8/1976 | McKee | 297/328 |
| 3,989,297 | 11/1976 | Kerstholt | 297/306 X |
| 4,062,587 | 12/1977 | Wolters | 297/374 X |
| 4,070,058 | 1/1978 | Muehling | 297/374 |
| 4,101,167 | 7/1978 | Ornberg | 297/328 |
| 4,198,094 | 4/1980 | Bjerknes et al. | 297/355 |
| 4,208,071 | 6/1980 | Pesiri | 297/369 |
| 4,354,710 | 10/1982 | Rauschenberger | 297/356 |
| 4,372,611 | 2/1983 | Feddeler | 297/371 |
| 4,384,743 | 5/1983 | Barley | 297/355 |
| 4,390,206 | 6/1983 | Faiks et al. | 297/300 |
| 4,418,583 | 12/1983 | Taig | 74/501.5 |
| 4,478,454 | 10/1984 | Faiks | 297/316 |
| 4,494,795 | 1/1985 | Roossien et al. | 297/355 |
| 4,627,662 | 12/1986 | Carter et al. | 297/313 |
| 4,636,004 | 1/1987 | Neumuller | 297/374 |
| 4,640,547 | 2/1987 | Fromme | 297/301 |
| 4,660,886 | 4/1987 | Terada et al. | 297/367 |
| 4,693,514 | 9/1987 | Volkle | 297/374 |
| 4,720,142 | 1/1988 | Holdredge et al. | 297/300 |
| 4,911,501 | 3/1990 | Decker et al. | 297/300 |
| 4,958,536 | 9/1990 | Baumgarten | 74/501.6 X |
| 5,007,678 | 4/1991 | DeKraker | 297/353 |
| 5,046,780 | 9/1991 | Decker et al. | 297/302 |
| 5,066,069 | 11/1991 | DeGelder | 297/374 |
| 5,107,720 | 4/1992 | Hatfield | 74/500.5 X |

FOREIGN PATENT DOCUMENTS

| | | | |
|---|---|---|---|
| 0640801 | 6/1962 | Italy | 74/500.5 |

*Primary Examiner*—Kenneth J. Dorner
*Assistant Examiner*—Milton Nelson, Jr.
*Attorney, Agent, or Firm*—Price, Heneveld, Cooper, DeWitt & Litton

[57] ABSTRACT

An adjustable chair includes a base, a seat, a back and a chair control for pivotally connecting the back to the base for movement between an upright position and an inclined position. The seat is pivoted to the base at a front end. The seat is also connected to the base by a plurality of locking plates. A spring clamp normally holds the plates in a locked position. The clamp permits pivotal adjustment of the seat with respect to the base. A cable actuated back stop or lock includes a lever pivoted to the back. When in the operative position, the lever contacts the locking plates connected to the seat to limit or prevent tilting of the back with respect to the seat.

25 Claims, 7 Drawing Sheets

CHAIR WITH BACK LOCK

BACKGROUND OF THE INVENTION

The present invention relates to office furniture and, more particularly, to adjustable chairs.

A wide variety of chairs are available which are principally adapted to the office environment. Such chairs include adjustable features to adapt them to the particular user and the task involved. The users of the chairs may, of course, vary significantly in physical characteristics. Such chairs may permit the chair back to tilt with respect to the seat and the base. Vertical height adjustment of the seat may be provided. The chair back may be vertically adjustable with respect to the seat. In addition, provision may be made for adjusting the seat position relative to the base and/or relative to the back. Examples of prior task oriented, adjustable chairs including some of these features may be found in U.S. Pat. No. 5,007,678 entitled CHAIR BACK HEIGHT ADJUSTMENT MECHANISM, which issued on Apr. 16, 1991 to DeKraker; U.S. Pat. No. 4,478,454 entitled WEIGHT-ACTUATED CHAIR CONTROL, which issued on Oct. 23, 1984 to Faiks and U.S. Pat. No. 4,198,094 entitled WORKING CHAIR, which issued on Apr. 15, 1980 to Bjerknes et al.

The chair may also include a stop mechanism to limit tilting motion of the chair back with respect to the base or the seat. The stop mechanism may provide a variable stop which results in a variety of maximum tilt positions. In the alternative, the mechanism may lock the seat back in an upright position and/or in a variety of different angular positions and, hence, prevent all tilting action. Examples of chairs including variable stop or lock mechanisms may be found in U.S. Pat. No. 4,720,142 entitled VARIABLE BACK STOP, which issued on Jan. 19, 1988 to Holdredge; U.S. Pat. No. 4,494,795 entitled VARIABLE BACK ADJUSTER FOR CHAIRS, which issued on Jan. 22, 1985 to Roossien and U.S. Pat. No. 4,390,206 entitled SYNCHROTILT CHAIR CONTROL, which issued on Jun. 28, 1984 to Faiks et al.

A need exists for an improved adjustable chair which achieves seat and back angular adjustment as well as locking of the back in a cost effective and reliable manner.

SUMMARY OF THE INVENTION

In accordance with the present invention, the aforementioned needs are fulfilled. Essentially, an adjustable chair is provided with a chair control wherein the seat angular position is adjustable relative to a base, and the chair back is mounted on the base through a control which permits the back to tilt relative thereto. Provision is made for locking or stopping tilt action of the back relative to the angular position of the seat.

In narrower aspects of the invention, a plurality of seat plates are interposed with a plurality of base plates. A spring mechanism clamps the plates together to lock the position of the seat. The seat plates are connected to a rear portion of the seat. The front portion of the seat is pivoted to the base of the chair. A chair back tilt limiting stop or lock mechanism includes a lever pivotal from an inoperative position to an operative position. When in the operative position, the lever engages the seat locking plates to lock the back in an upright position or to limit the back travel relative to the seat. In the preferred form, the lever is actuated by a cable actuator including a cable assembly and a moveable button which is mounted on the seat. Angular adjustment of the seat with respect to the base is provided. The back may tilt from a fully upright position to a fully reclined position. Backward tilting of the chair back may be limited or prevented to adjust the chair to the physical characteristics of the user or to the particular task being performed. The stop mechanism is easily actuated from a seated position through the cable actuator. The chair control and mechanism are relatively economical to manufacture, efficient in use and capable of a long and reliable life.

DETAILED DESCRIPTION OF THE PREFERRED EMBODIMENT

Figure 1:
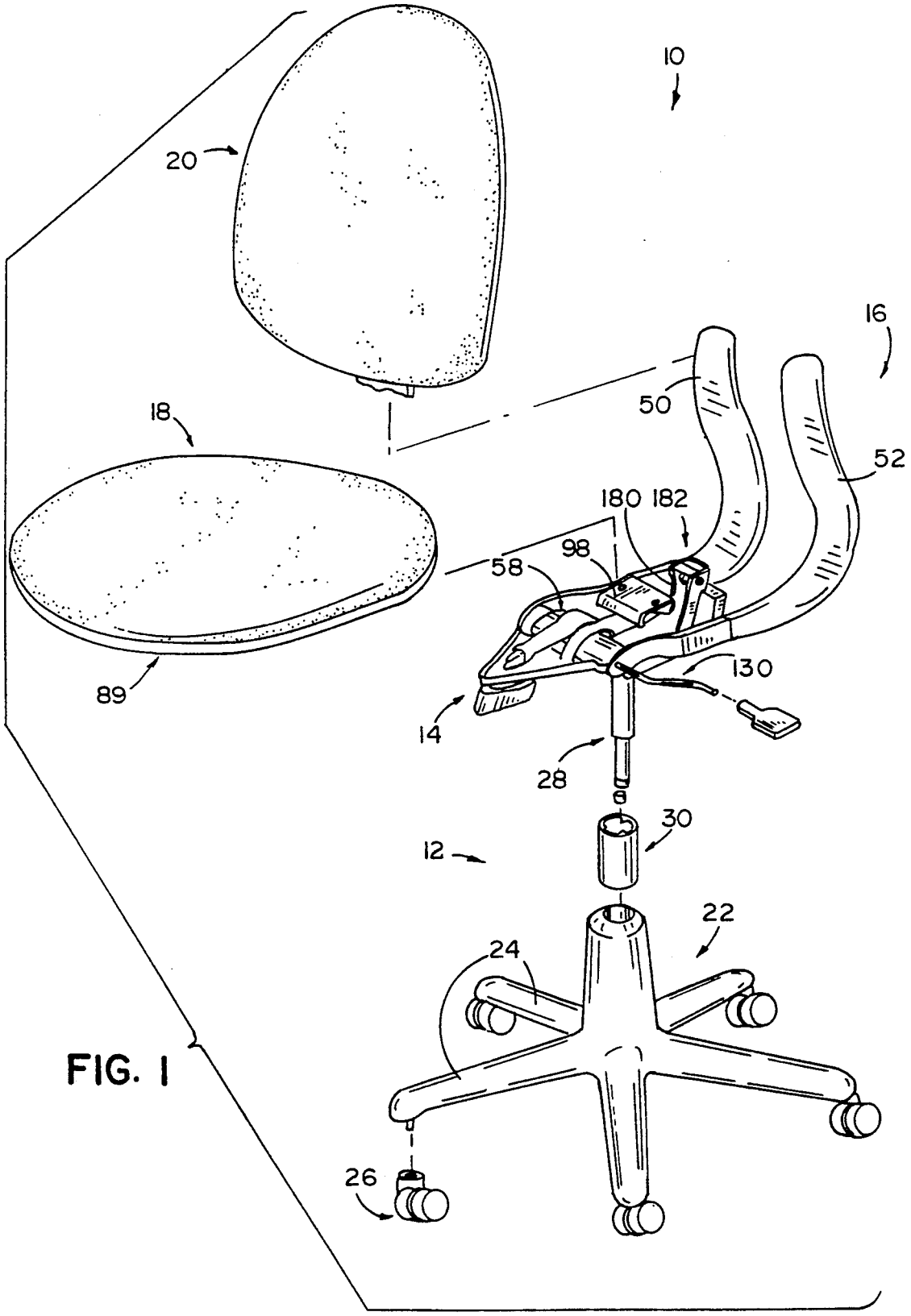
FIG. 1 is an exploded view of a chair in accordance with the present invention.

An adjustable chair in accordance with the present invention is illustrated in FIG. 1 and generally designated by the numeral 10. Chair 10 includes a base or pedestal subassembly 12, a control and housing subassembly 14, an upright or back support subassembly 16, a seat 18 and a back subassembly 20. Back support subassembly 16 and back subassembly 20 form the back of the chair. Base subassembly 12 includes a pedestal 22 with a plurality of arms 24 having castors 26. A tubular member or spindle 28 is included with housing subassembly 14. Tubular member 28 and another tubular member 30 may be positioned within pedestal 22. The base subassembly permits vertical height adjustment of the housing subassembly 14 and, hence, seat 18 with respect to the ground. The vertical height adjustment may be achieved mechanically through a screw arrangement or a gas or pneumatic spring may be used. Such adjustment mechanisms are conventional.

Figure 2:
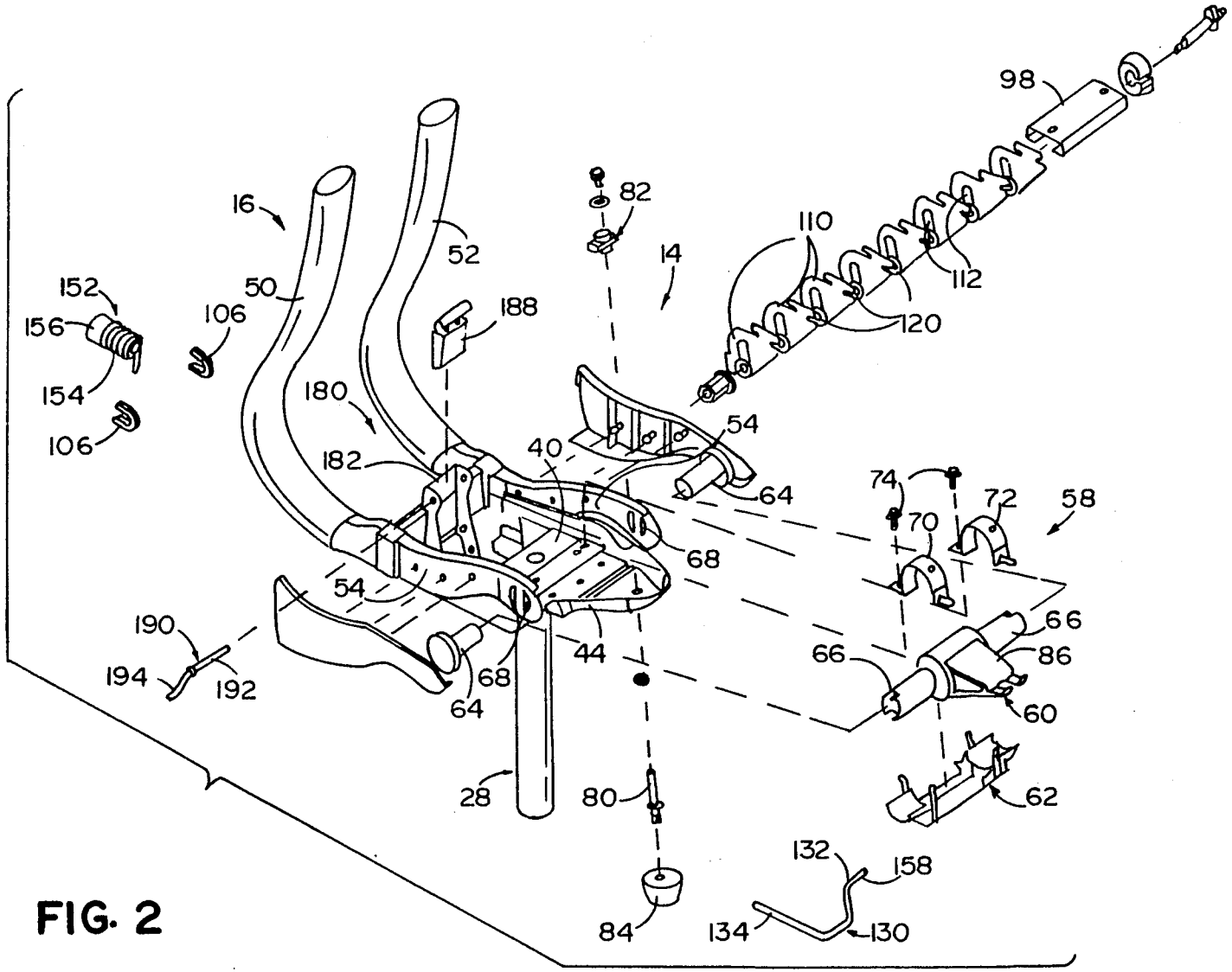
FIG. 2 is an exploded view of a portion of the chair of FIG. 1.
Figure 3:
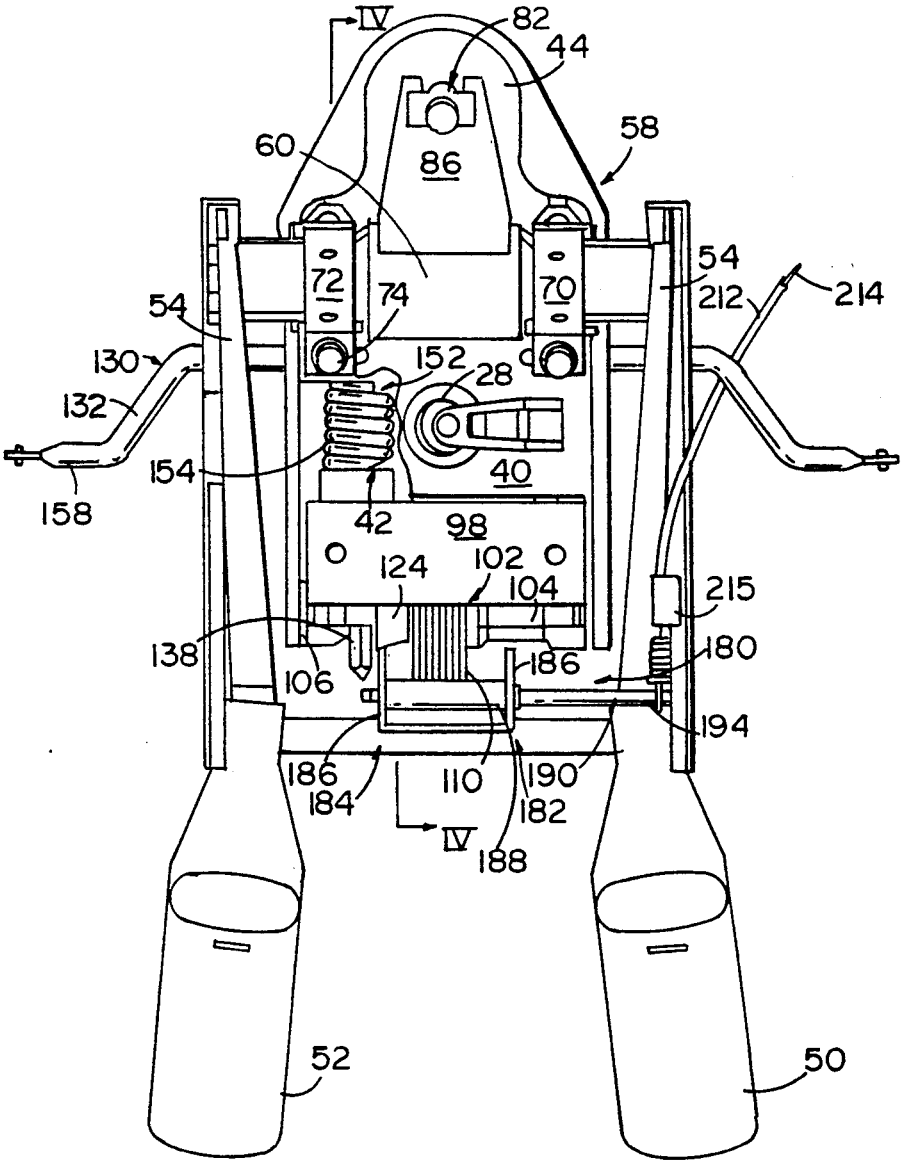
FIG. 3 is a top plan view of the housing and upright assembly in accordance with the present invention.
Figure 4:
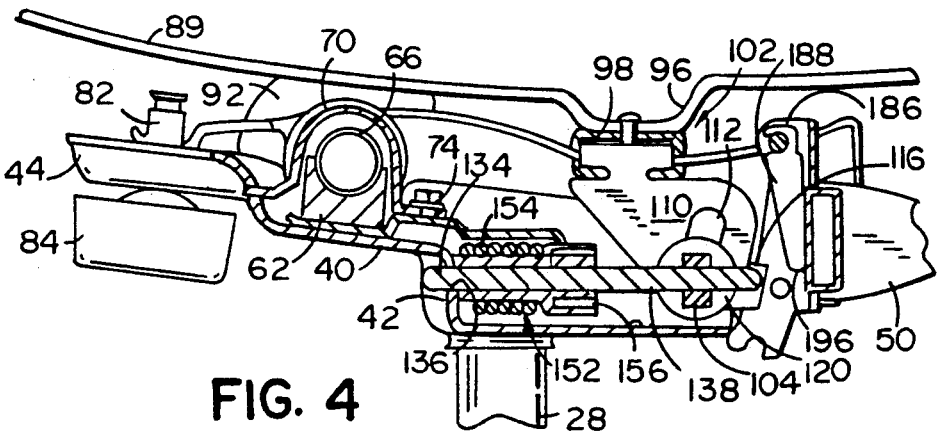
FIG. 4 is a cross-sectional view taken generally along line IV—IV of FIG. 3.
Figure 5:
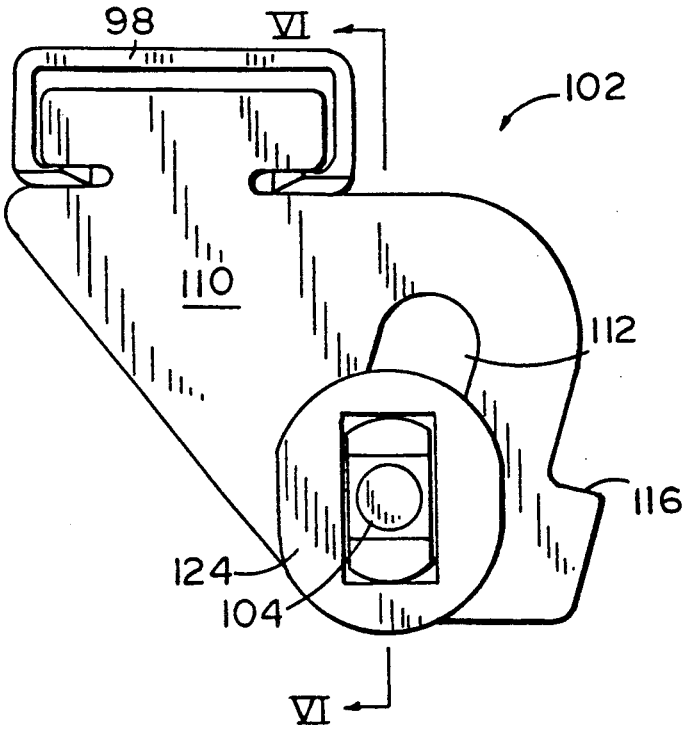
FIG. 5 is a side elevational view of a portion of the seat adjustment mechanism of the present invention.

As seen in FIGS. 2, 3 and 4, housing subassembly 14 includes a base plate 40 which is welded or otherwise suitably secured to the top of tubular member 28. Base plate 40 includes a central portion 42 and a forward lip portion 44. Upright subassembly 16 includes a pair of configured, generally tubular upright members 50, 52. Members 50, 52 each include a forward portion 54. A torsional energy storage device or spring subassembly 58 mounts members 50, 52 at their forward ends to the housing subassembly. Torsional energy storage device 58 includes a torsion spring and axle or bushing subassembly 60 which is received in a support bearing 62. Support bearing 62 is secured to forward portion 44 of the housing base plate. Torsional bushing plugs 64 are positioned on the axle portions 66 and subassembly 60 is placed on support bearing 62. The outer ends of the axle portions 66 are received in apertures 68 defined by forward portions of upright members 50, 52. Retaining clamps 70, 72 are secured by suitable fasteners 74 to clamp subassembly 60 on the housing subassembly.

Tension or initial preload is adjusted by a subassembly, which includes an adjusting insert or rod 80 which extends through an aperture in forward portion 44 of the base plate. An adjusting nut 82 is secured to an upper end of rod 80. A tension handle or knob 84 is secured to a lower end of rod 80. Rotation of knob 84 causes forward portion 86 of the torsion bushing subassembly 60 to pivot about the centerline of axles 66 thereby setting the initial position of uprights 50, 52 or their preload. Upright subassembly 16 is, therefore, pivoted to housing subassembly 14. The uprights 50, 52 and, hence, the chair back are spring biased to a forward or upright position. The uprights may tilt rearwardly to a reclined position.

The base subassembly, housing subassembly, upright subassembly and torsional energy storage subassembly 58 are conventional in nature. It is preferred that back subassembly 20 be vertically adjustable on the uprights. The back subassembly is constructed in accordance with the aforementioned U.S. Pat. No. 5,007,678, which is incorporated herein by reference.

Seat 18 includes a shell 89 having a pair of laterally spaced hook-like portions 92 joined to an under-surface thereof. The hook-like portions are received over or around axle portions 66 of subassembly 58 (FIG. 4). Seat 18 is, therefore, pivoted to the housing subassembly and, hence, to ground. A rear portion 96 of seat 18 is attached to a generally channel-shaped seat bracket 98. Bracket 98 is adjustably mounted on housing subassembly 14 by a lock mechanism generally designated 102.

As shown in FIGS. 2–6, lock mechanism 102 includes a lock axle 104. Axle 104 is mounted on a rearward portion of housing subassembly 14. Ends of axle 104 are received in lock axle bushings 106 (FIG. 2). Bushings 106 extend or are positioned within rearwardly opening slots defined by the housing subassembly base plate 40. A first set of seat locking plates 110 are positioned on axle 104. Plates 110 each include a vertically extending slot 112 through which axle 104 extends. An upper portion 114 of each plate 110 is captured by seat bracket 98. The angular position of seat 18 is, therefore, determined by the position of lock plates 110 with respect to axle 104. In the embodiment of Figs. 2–6, each plate 110 further defines a stop shoulder or surface 116. A plurality of washer-like ground or base locking plates 120 are interposed with lock plates 110. Plates 120 each define an aperture through which axle 104 extends. The vertical position of each plate 120 is, therefore, fixed with respect to ground by the axle 104. Plates 110, due to the vertical slots 112, may be shifted vertically with respect to axle 104 and plates 120.

Figure 6:
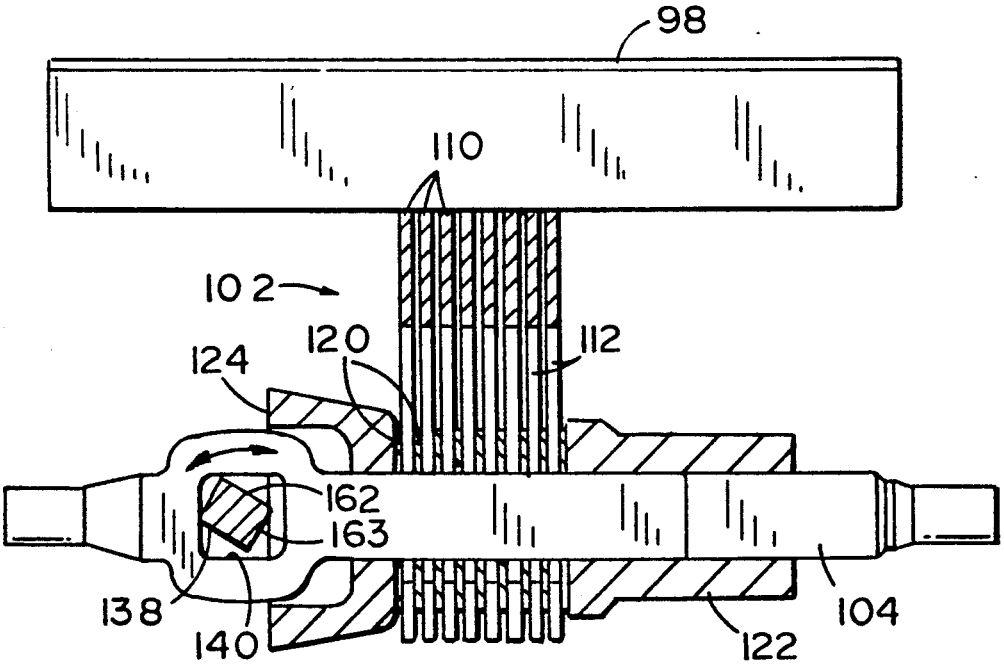
FIG. 6 is a cross-sectional view taken along line VI—VI of FIG. 5.

Lock subassembly 102 further includes an adjusting nut 122 threaded to one end of axle 104 and a spacer or clamp member 124 positioned on the opposite end of axle 104. Provision is made for resiliently biasing clamp member 124 into engagement with an outer locking plate 120 so that the plates are locked into position with respect to each other in a clutch-like fashion. As shown, a configured locking lever 130 is pivotally mounted on housing subassembly base plate 40. Locking lever 130 includes an angled portion 132 and an elongated portion 134. Portion 134, as shown in FIG. 4, extends through an aperture 136 defined by base plate 40. Portion 134 includes an end 138 which extends through an aperture 140 formed in the lock axle 104 (FIGS. 4 and 6). End 138 abuts against clamp member 124. End portion 138 has a noncircular or generally rectangular cross section including flats or sides 162, 163. The outer surface of portion 138, therefore, defines a camming surface.

A torsion spring assembly 152 includes a spring 154 and a coupler 156 which is positioned on lock actuating lever 130. Upward movement of a handle portion 158 of actuator 130 rotates elongated portion 134 to move flat 162 to disengage the actuator from clamp member 124 (FIG. 6). This permits clamp member 124 to shift to the left when viewed in FIG. 6, since side 163 of portion 138 is shorter than side 162. Clamping pressure on the interposed locking plates 110, 120 is released. Plates 110 are, therefore, now free to move vertically with respect to axle 104 and, hence, the base. The tilt position of seat 18 is manually adjustable. When handle 158 is released, spring 154 rotates portion 138 in a counterclockwise direction, as viewed in FIG. 6, forcing clamp 124 into engagement with plate 120. The plates are now locked in position.

As best seen in FIGS. 2, 3, 4 and 13, a back lock or stop mechanism 180 is included to set the position of upright subassembly 16 and, hence, back 20 with respect to the seat. A back bracket 182 is fixed to and extends between uprights 50, 52. Back bracket 182 includes a central, channel-shaped or generally U-shaped portion 184 having sides 186. A back stop lever 188 is pivoted to sides 186 of bracket portion 184 by a back stop shaft 190. Shaft 190 includes an elongated portion 192 upon which lever 188 is non-rotatably positioned. The shaft further includes an eccentrically positioned outer portion 194. As should be apparent from FIGS. 3 and 4, rotation of shaft 190 and, hence, lever 188 towards the front end of the chair will position a lower end 196 of the lever so that it contacts stop surfaces 116 of seat lock plates 110. As a result, the back or upright subassembly 16 cannot pivot about axle portions 66. The back is, in effect, locked in an upright position relative to the seat.

Figure 13:
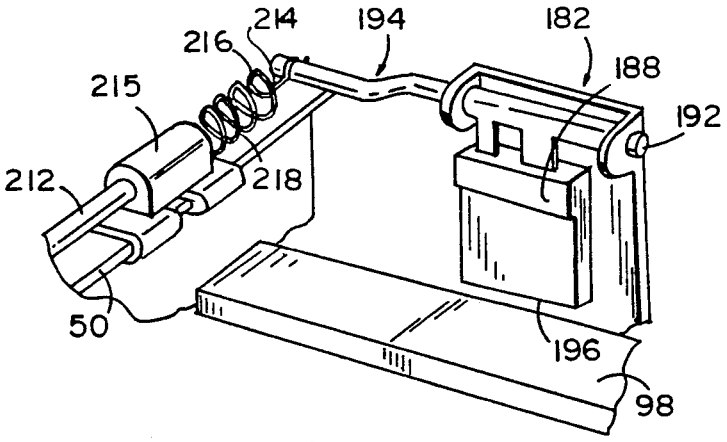
FIG. 13 is a fragmentary, perspective view showing a portion of the back stop assembly in accordance with the present invention.

An actuator subassembly is provided to rotate shaft 190. As shown in FIGS. 3, 7–11 and 13, the actuator includes a Bowden-type cable assembly 210. Cable assembly 210 includes a tubular housing 212 and a cable 214. An end of cable 214 is attached to shaft 190 at its outer portion 194 (FIG. 13). An attachment member or housing stop 215 is snapped on portion 54 of upright 50. Stop 215 positions an end of cable housing 212. A spring stop 216 is secured to the end of cable 214 adjacent lock lever 190. A coil spring 218 is positioned between spring stop 216 and housing stop 215. As a result, cable 214 is resiliently biased so that the lock shaft 190 is rotated to position lock or stop 188 at a rearward or inoperative position. Shifting of cable 214 to the left, when viewed in FIG. 13, rotates shaft 190 and moves stop 188 to an operative position where it will engage stop surfaces 116.

Figure 7:
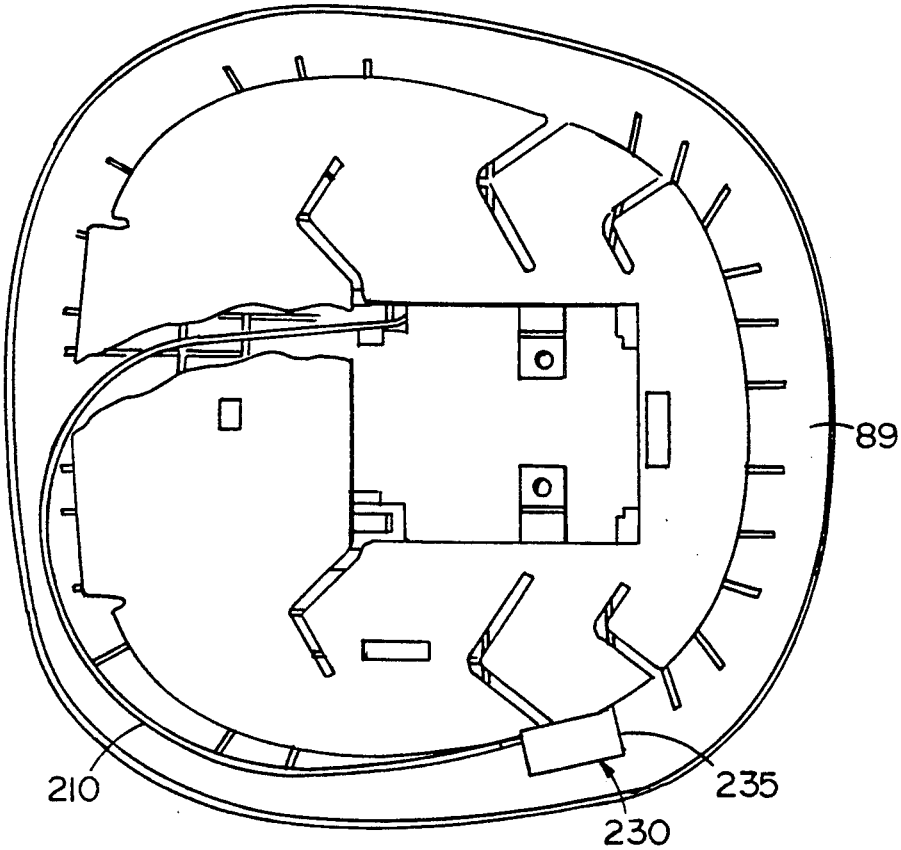
FIG. 7 is a top plan view of the seat shell.
Figure 11:
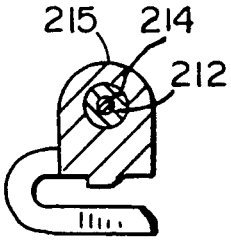
FIG. 11 is a cross-sectional view taken along line XI—XI of FIG. 10.
Figure 9:
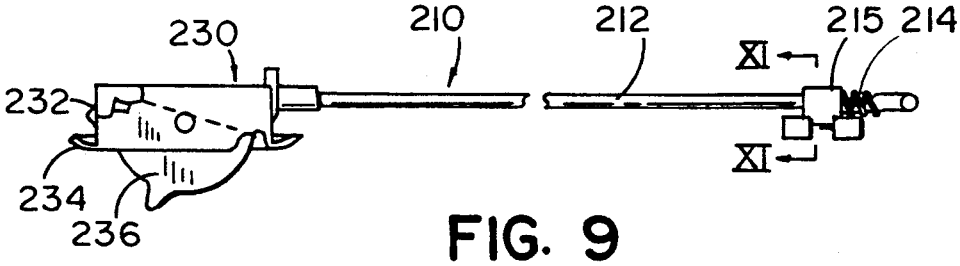
FIG. 9 is a side view thereof.
Figure 10:
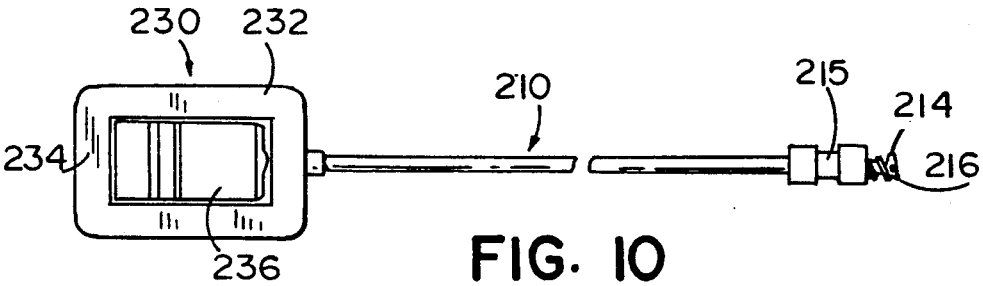
FIG. 10 is a top view thereof.
Figure 8:
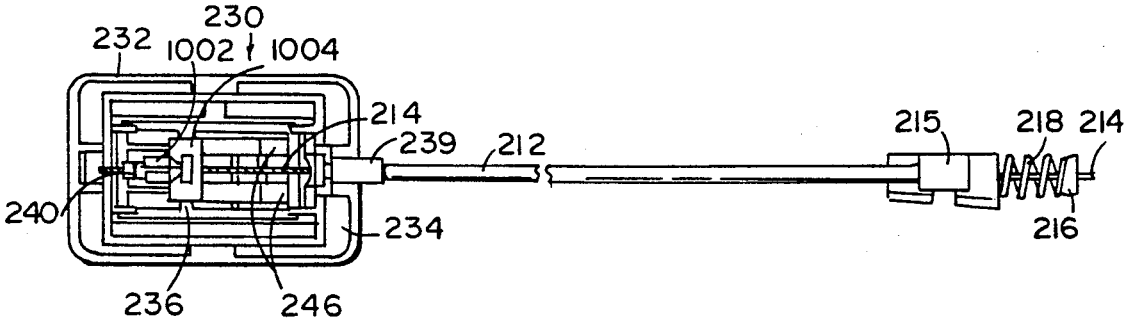
FIG. 8 is a bottom view of the cable actuator included in the present invention.

Cable 214 is shifted within its housing 212 by an actuator button subassembly 230, as shown in FIGS. 7–10. Button subassembly 230 includes a generally rectangular housing 232 which includes a peripheral flange 234. Housing 230 is adapted to be secured in a suitable aperture 235 in the undersurface of seat shell 89 (FIG. 7). Button actuator subassembly 230 is conveniently located for easy access by the user of the chair. An actuator button 236 is pivotally mounted to sides 238 of housing 232. Cable subassembly 210 includes an end of housing 212 which is received within a boss portion 239 formed as part of the housing 232. A free end 240 of cable 214 is attached to a leaf spring 1002 which rests against and is trapped by a retaining portion 1004 of button 236. Spring 1002 is a button over travel spring. As should be apparent, rotation of button 236 from the position shown in FIG. 9 to the position shown in FIG. 12 will pull cable 214 thereby pivoting the lock shaft 190 and positioning the stop lever in the operative position. If the back is reclined so that lever 188 can not move to its operative position, leaf spring 1002 will compress to accommodate the button movement since shifting or movement of cable 214 is prevented. This prevents breakage of the mechanism. When subassembly 16 moves to an upright position, spring 1002 expands and shifts cable 214 moving lever 188 to its lock position.

Figure 12:
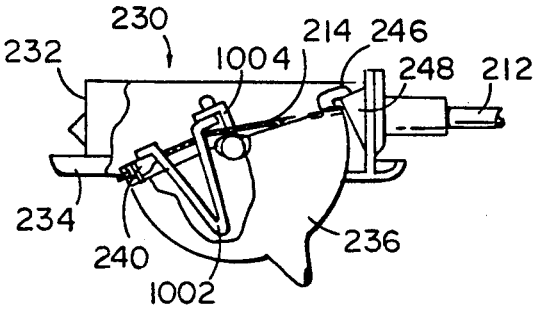
FIG. 12 is a side elevational view of the button actuator.

Provision is made for retaining the button 236 in the operative or locked position in a positive fashion. As shown in FIG. 12, button 236 includes a pair of generally L-shaped, resilient detents 246. Housing 232 includes a lock flange or detent flange 248. As button 236 is rotated to the locked position, as shown in FIG. 12, detents 246 cam over detent flanges 248 until flanges 248 are positioned below the detents. Button 236 is now held in the locked position in a positive fashion. Sufficient pressure must be applied to button 236 to cam detents 246 off of detent flanges 248. Once the detents snap off the flanges, however, spring 218 shifts cable 214 rotating the button 236 to the unlocked position and rotating lock lever 188 to the inoperative position.

The chair in accordance with the present invention permits angular adjustment of seat 18 with respect to the back and ground. This permits the chair seat to be positioned with respect to the back to accommodate the varying physical characteristics of the users of the chair. This also permits the chair to be configured for the particular task being carried out. The back is pivoted to the base by a tilt mechanism which includes a torsion subassembly. The back may, however, be locked in an upright position by rotation of lock lever 188 from its inoperative to its operative position. When in the operative position, rearward tilting action of the back is prevented or limited since the stop lever will engage stop surfaces 116 defined by seat locking plates 110. When in the locked position, the angular position of the back or upright subassembly 16 is set relative to the angular position of the seat 18. The upright position of the back is, therefore, set with respect to the seat after its angular position has been determined by the user. The angular position of seat 18 is readily set by merely pulling on the actuator handle 158 releasing the pressure on the clutch plates or locking plates 110, 120 permitting the seat to pivot about axle portions 66.

Figure 14:
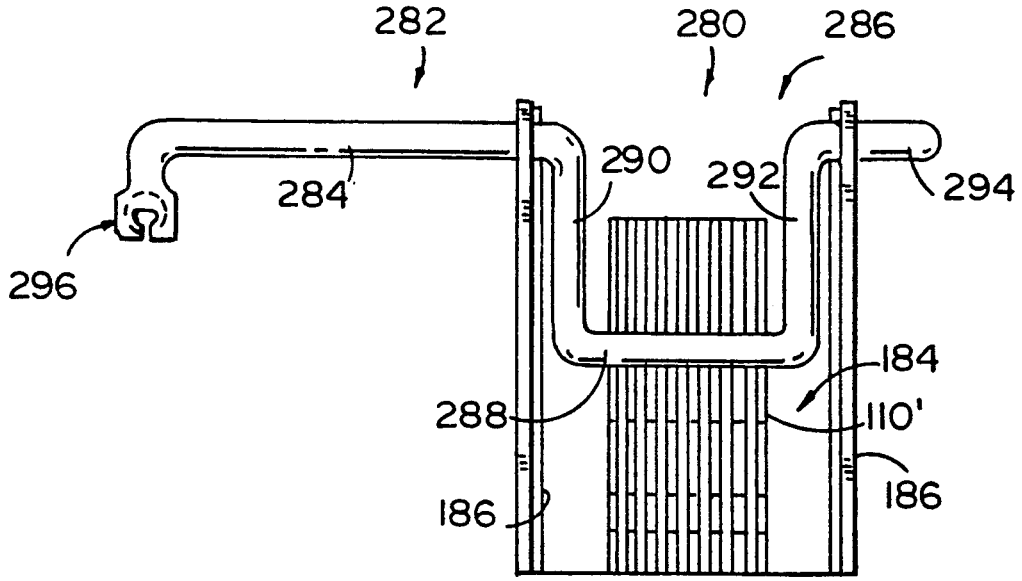
FIG. 14 is a fragmentary, rear elevational view of an alternative embodiment of the back stop in accordance with the present invention.
Figure 15:
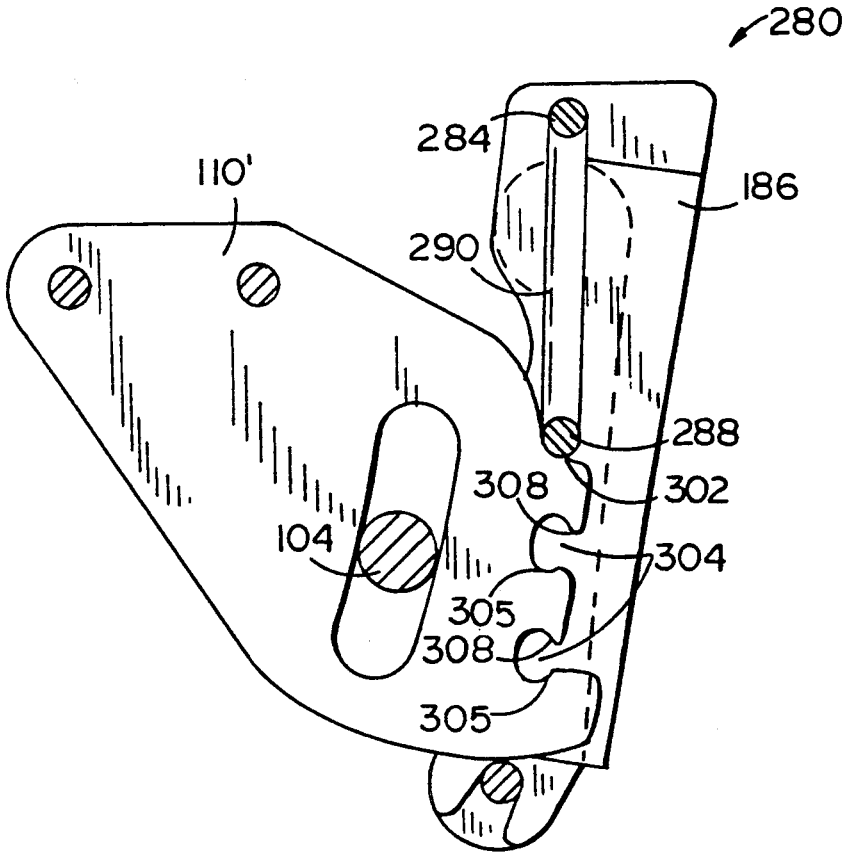
FIG. 15 is a fragmentary, side elevational view of the embodiment of FIG. 14.

An alternative embodiment of the lock or stop assembly is illustrated in FIGS. 14 and 15 and generally designated by numeral 280. Lock assembly 280 includes a lock lever 282. Lever 282 includes an elongated actuator shaft portion 284 and a generally U-shaped portion 286. Portion 286 includes a base 288 and uprights 290, 292. Lever 280 further includes an end axle portion 294. Portion 294 extends through a side 186 of the back bracket 184. Elongated portion 284 extends through an opposite side of the back bracket. The U-shaped portion is, therefore, pivoted with respect to the back bracket. Actuator cable 214 is attachable to a cable end 296 of the lever. Cable housing 212 is secured to a portion of the upright 50, as described above. Spring 218 biases lever 282 from an operative position shown in FIG. 15 to an inoperative position.

In the embodiment of FIGS. 14 and 15, multiple upright lock or stop positions are provided. Seat locking plates 110' positioned on axle 104 define multiple stop surfaces or notches. As shown, the trailing edge of each plate defines an upper stop surface 302 and a plurality of stop notches 304 having stop surfaces 305. With the seat back in the fully upright position, lock lever 280 may be rotated to the operative position at which it will engage stop surface 302. This prevents tilting action of the back subassembly. In the alternative, the back subassembly may be tilted rearwardly until base portion 288 of lock lever 280 may be received in one of the notches 304. When so positioned, the back will be locked in one of a plurality of angular positions. It is presently preferred that the notches 304 define hook portions 308 at their entrances. When the lock lever portion 288 is disposed within the notches, the portions 308 will prevent removal therefrom or hold the lock lever in position until weight is put against the back subassembly. Some tilting of the back subassembly rearwardly is necessary to permit lever portion 288 to be pivoted or removed from the respective notch.

In view of the foregoing description, one of ordinary skill in the art may envision various modifications to the invention which will not depart from the inventive concepts disclosed. It is intended, therefore, that the above description should be considered as only that of the preferred embodiments. The true spirit and scope of the present invention may be determined by reference to the appended claims.

The embodiments of the invention in which an exclusive property or privilege is claimed are defined as follows:

1. An adjustable chair, comprising:

a base;

a back;

control means connecting the back to the base for allowing the back to tilt about an axis between a fully upright position and a fully inclined position;

a seat having a forward portion pivoted to the base;

adjustment means connecting a rearward portion of the seat to the base for allowing selective adjustment and locking of the angle of the seat relative to said base while allowing tilting of the back between the upright and inclined positions, said adjustment means including a plurality of seat locking plates connected to said seat; and a back lock mechanism on said back and separate from said adjustment means for engaging said locking plates and locking the back at a locked position relative to said base to prevent rearward tilting of the back and wherein the angular position of the back in the locked position is set relative to the angular position of the seat.

2. An adjustable chair as defined by claim 1 wherein said adjustment means comprises:

a lock axle on said base;

a plurality of base locking plates on said axle and interposed with said seat locking plates, said seat locking plates each defining an elongated slot through which said axle extends, said seat being attached to said seat locking plates; and spring means on said base for clamping said plates together to lock the seat in position.

3. An adjustable chair as defined by claim 1 wherein said back lock mechanism comprises:

a lever pivoted to the back; and actuator means connected to said lever for pivoting said lever between inoperative and operative positions, said lever engaging said locking plates when in said operative position.

4. An adjustable chair as defined by claim 3 wherein said actuator means comprises a cable having an end connected to an actuator button.

5. An adjustable chair as defined by claim 3 wherein said actuator means comprises:

a button housing adapted to be mounted on the chair; and a button moveably mounted on said button housing, said button being moveable between operative and inoperative positions.

6. An adjustable chair as defined by claim 3 wherein said lever is generally U-shaped including a base and upstanding legs, said legs being pivoted to said back.

7. An adjustable chair, comprising:

a base;

a back;

control means connecting the back to the base for allowing the back to tilt about an axis between an upright position and an inclined position;

a seat pivoted to the base;

adjustment means connecting another portion of the seat to the base for allowing selective adjustment of the angle of the seat relative to said base, said adjustment means including a plurality of seat locking plates connected to said seat; and a back lock mechanism on said back for engaging said locking plates and locking the back at an upright position relative to said seat, said back lock mechanism comprising:

a lever pivoted to the back; and actuator means connected to said lever for pivoting said lever between inoperative and operative positions, said lever engaging said locking plates when in said operative position, and wherein said actuator means comprises:

a button housing adapted to be mounted on the chair;

a button moveably mounted on said button housing, said button being moveable between operative and inoperative positions;

a cable assembly including a housing having an end fixed to the button housing and another end fixed to the back and a cable having a first end fixed to said lever and a second end fixed to said button; and spring means operatively connected to said lever for resiliently biasing said lever to its inoperative position.

8. An adjustable chair as defined by claim 7 wherein said actuator further includes a button over travel spring connecting the cable second end to said button.

9. An adjustable chair as defined by claim 8 further including means on said button and said button housing for holding said button in a locked position in a positive, detent fashion.

10. An adjustable chair, comprising:

a base;

a back;

control means connecting the back to the base for allowing the back to tilt about an axis between an upright position and an inclined position;

a seat pivoted to the base;

adjustment means connecting another portion of the seat to the base for allowing selective adjustment of the angle of the seat relative to said base, said adjustment means including a plurality of seat locking plates connected to said seat; and a back lock mechanism on said back for engaging said locking plates and locking the back at an upright position relative to said seat, said adjustment means comprising:

a lock axle on said base;

a plurality of base locking plates on said axle and interposed with said seat locking plates, said seat locking plates each defining an elongated slot through which said axle extends, said seat being attached to said seat locking plates; and spring means on said base for clamping said plates together to lock the seat in position, and wherein said spring means comprises:

a clamp member moveably positioned on said lock axle;

an actuator having a camming surface engaging said clamp member; and a spring engaging the actuator and moving the camming surface into engagement with the clamp member to hold the base locking plates and seat locking plates in a locked position with respect to each other in a clutch-like fashion.

11. An adjustable chair as defined by claim 10 wherein said back lock mechanism comprises:

a lever pivoted to the back of said chair; and actuator means connected to said lever for pivoting said lever between inoperative and operative positions, said lever engaging said locking plates when in said operative position.

12. An adjustable chair as defined by claim 11 wherein said actuator means comprises:

a button housing adapted to be mounted on the chair; and a button moveably mounted on said button housing, said button being moveable between operative and inoperative positions.

13. An adjustable chair as defined by claim 12 wherein said actuator means further comprises:

a cable assembly including a housing having an end fixed to the button housing and another end fixed to the back and a cable having an end fixed to said lever and an end fixed to said button; and spring means engaging said lever for resiliently biasing said lever to its inoperative position.

14. An adjustable chair as defined by claim 13 further including means on said button and said button housing for holding said button in a locked position in a positive, detent fashion.

15. An adjustable chair, comprising:

a base;

a back;

control means connecting the back to the base for allowing the back to tilt about an axis between an upright position and an inclined position;

a seat pivoted to the base;

adjustment means connecting another portion of the seat to the base for allowing selective adjustment of the angle of the seat relative to said base, said adjustment means including a plurality of seat locking plates connected to said seat; and a back lock mechanism on said back for engaging said locking plates and locking the back at an upright position relative to said seat and wherein said back lock mechanism comprises:

a lever pivoted to the back; and actuator means connected to said lever for pivoting said lever between inoperative and operative positions, said lever engaging said locking plates when in said operative position, said lever being generally U-shaped including a base and upstanding legs, said legs being pivoted to said back, said seat locking plates each including a trailing edge and wherein each seat locking plate further defines a plurality of notches which are vertically spaced along said trailing edge, said notches dimensioned to receive said base of said U-shaped lever.

16. An adjustable chair as defined by claim 15 wherein said actuator means comprises:

a button housing adapted to be mounted on the chair; and a button moveably mounted on said button housing, said button being moveable between operative and inoperative positions.

17. An adjustable chair as defined by claim 16 wherein said actuator means further comprises:

a cable assembly including a housing having an end fixed to the button housing and another end fixed to the back and a cable having an end fixed to said lever and an end fixed to said button; and spring means engaging said lever for resiliently biasing said lever to its inoperative position.

18. A seat support and back stop assembly for an adjustable chair of the type including a back support pivoted to a base for movement between a fully upright position and a fully reclined position, said assembly comprising:

a seat bracket;

seat lock means connectable to and interconnecting the seat bracket and the base for permitting vertical adjustment of the seat bracket relative to said base and locking the seat bracket in position while permitting tilting of said back support to said fully reclined position, said seat lock means including a plurality of seat plates on said seat bracket; and a back stop means adapted to be mounted on the back support for limiting tilting movement of the back support relative to said seat bracket, said back stop means including a stop lever, means for pivoting the stop lever to the back support, actuator means connected to the stop lever for moving said stop lever from an inoperative position to an operative position and wherein said seat plates define a stop surface engaged by said stop lever when said lever is in the operative position.

19. An assembly as defined in claim 18 wherein said stop lever is generally U-shaped including a base and legs, said legs being pivoted to said back support.

20. A seat support and back stop assembly for an adjustable chair of the type including a back support pivoted to a base for movement between an upright position and a reclined position, said assembly comprising:

a seat bracket;

seat lock means connectable to the seat bracket and the base for permitting vertical adjustment of the seat bracket relative to said base, said lock means including a plurality of seat plates; and a back stop means adapted to be mounted on the back support for limiting tilting movement of the back support relative to said seat bracket, said back stop means including a stop lever, means for pivoting the stop lever to the back support, actuator means connected to the stop lever for moving said stop lever from an inoperative position to an operative position and wherein said seat plates define a stop surface engaged by said stop lever when said lever is in the operative position, said stop lever being generally U-shaped including a base and legs, said legs being pivoted to said back support, and wherein said seat plates each include a trailing edge defining a plurality of stop surfaces vertically spaced therealong, said surfaces being selectively engageable by said lever base.

21. An assembly as defined by claim 18 wherein said lock means further includes:

a lock axle adapted to be mounted on said base;

a plurality of base lock plates on said axle interposed with said seat plates, said seat plates each defining an elongated slot through which said axle extends; and spring means adapted to be mounted on said base for clamping said plates together to lock the seat bracket in position.

22. An assembly as defined by claim 21 wherein said actuator means comprises:

a button housing adapted to be mounted on the chair; and a button moveably mounted on said button housing, said button being moveable between operative and inoperative positions.

23. A seat support and back stop assembly for an adjustable chair of the type including a back support pivoted to a base for movement between an upright position and a reclined position, said assembly comprising:

a seat bracket;

seat lock means connectable to the seat bracket and the base for permitting vertical adjustment of the seat bracket relative to said base, said lock means including a plurality of seat plates; and a back stop means adapted to be mounted on the back support for limiting tilting movement of the back support relative to said seat bracket, said back stop means including a stop lever, means for pivoting the stop lever to the back support, actuator means connected to the stop lever for moving said stop lever from an inoperative position to an operative position and wherein said seat plates define a stop surface engaged by said stop lever when said lever is in the operative position, said lock means further including:

a lock axle adapted to be mounted on said base;

a plurality of base lock plates on said axle interposed with said seat plates, said seat plates each defining an elongated slot through which said axle extends; and spring means adapted to be mounted on said base for clamping said plates together to lock the seat bracket in position, said actuator means comprising:

a button housing adapted to be mounted on the chair; and a button moveably mounted on said button housing, said button being moveable between operative and inoperative positions, and wherein said actuator means further comprises:

a cable assembly including a housing having an end fixed to the button housing and another end fixed to the back support and a cable having an end fixed to said stop lever and an end fixed to said button; and spring means engaging said stop lever for resiliently biasing said stop lever to its inoperative position.

24. An assembly as defined by claim 23 wherein said stop lever is generally U-shaped including a base and legs, said legs being pivoted to said back support.

25. An assembly as defined by claim 24 wherein said seat plates each include a trailing edge defining a plurality of stop surfaces vertically spaced therealong, said surfaces being selectively engageable by said stop lever base.

* * * * *